US006397632B1

(12) United States Patent
Meagher

(10) Patent No.: US 6,397,632 B1
(45) Date of Patent: Jun. 4, 2002

(54) GRYOGENIC RECTIFICATION METHOD FOR INCREASED ARGON PRODUCTION

(75) Inventor: James Patrick Meagher, Buffalo, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/901,895

(22) Filed: Jul. 11, 2001

(51) Int. Cl.[7] ..... F25J 3/04
(52) U.S. Cl. ..... 62/648; 62/924
(58) Field of Search ..... 62/648, 924

(56) References Cited

U.S. PATENT DOCUMENTS

| | | | | | |
|---|---|---|---|---|---|
| 4,790,866 | A | | 12/1988 | Rathbone | 62/22 |
| 4,932,212 | A | | 6/1990 | Rohde | 62/22 |
| 5,078,766 | A | | 1/1992 | Guilleminot | 62/22 |
| 5,114,449 | A | | 5/1992 | Agrawal et al. | 62/22 |
| 5,245,831 | A | | 9/1993 | Agrawal et al. | 62/22 |
| 5,255,524 | A | | 10/1993 | Agrawal et al. | 62/22 |
| 5,305,611 | A | | 4/1994 | Howard | 62/22 |
| 5,313,800 | A | | 5/1994 | Howard et al. | 62/22 |
| 5,469,710 | A | | 11/1995 | Howard et al. | 62/22 |
| 5,528,906 | A | * | 6/1996 | Naumovitz | 62/652 |
| 5,682,767 | A | * | 11/1997 | De Bussy et al. | 62/648 |
| 5,704,228 | A | * | 1/1998 | Tranier | 62/643 |
| 5,724,835 | A | * | 3/1998 | Hine | 62/646 |

* cited by examiner

*Primary Examiner*—Ronald Capossela
(74) *Attorney, Agent, or Firm*—Stanley Ktorides

(57) ABSTRACT

A cryogenic rectification method for increasing the recovery of argon produced in an argon column of a cryogenic air separation plant wherein liquid nitrogen is mixed with higher pressure column kettle liquid to produce a liquid refrigeration mixture to drive the top condenser.

10 Claims, 1 Drawing Sheet

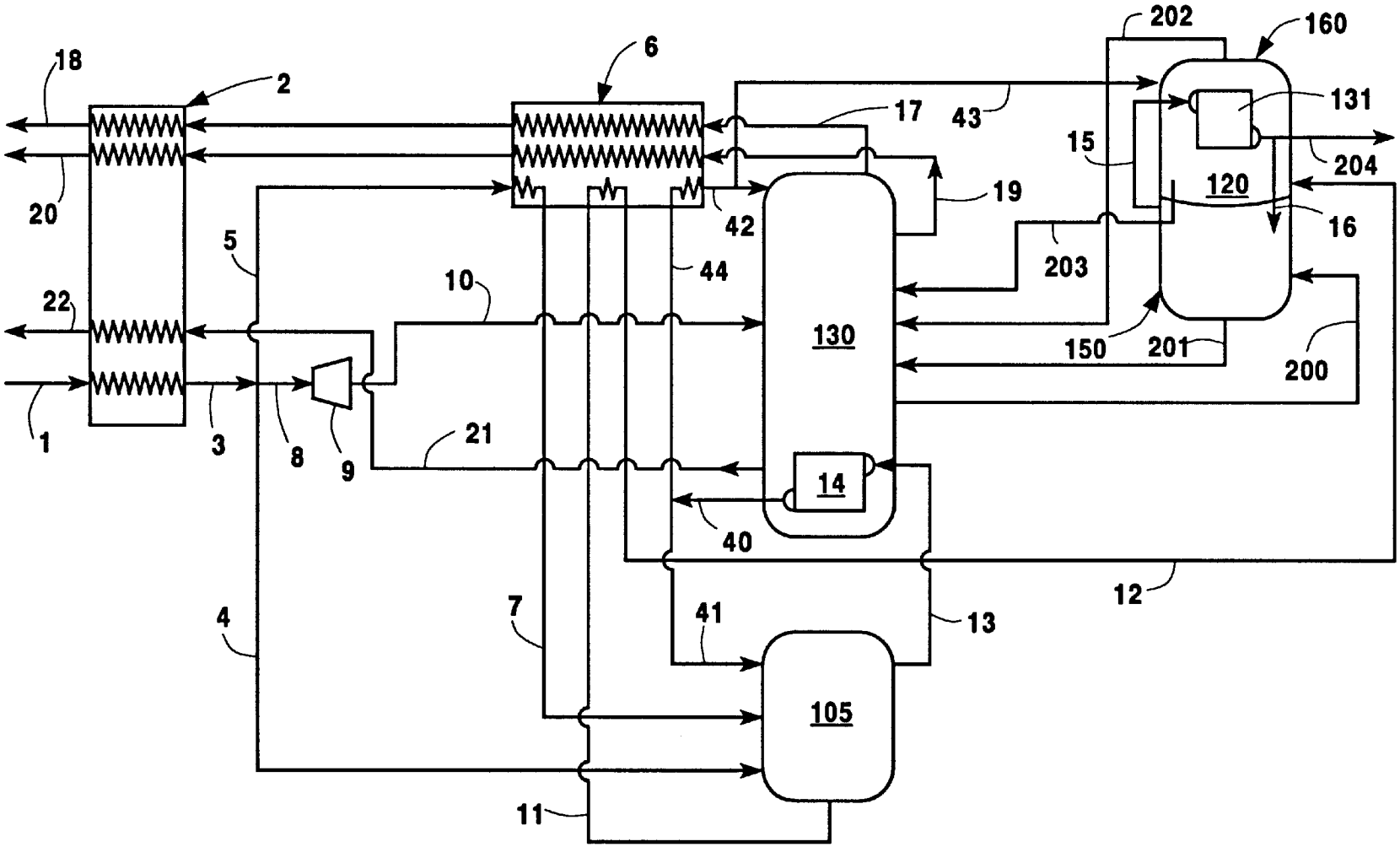
160
131
204
16
200
120
202
201
12
15
150
203
43
19
13
17
130
14
105
42
44
40
41
6
7
11
10
21
9
8
2
5
3
4
18
20
22
1

GRYOGENIC RECTIFICATION METHOD FOR INCREASED ARGON PRODUCTION

TECHNICAL FIELD

This invention relates generally to cryogenic air separation and, more particularly, to cryogenic air separation for producing argon.

BACKGROUND ART

In the production of argon by cryogenic air separation the actual recovery of argon in a plant is often reduced well below design levels due to operational concerns with the nitrogen tolerance of the crude argon condenser. Specifically, as the relative concentration of nitrogen increases at the top of the crude argon column (condensing side of the overhead condenser), the temperature required to completely liquefy the gas phase decreases. The lower limit of this condensing temperature is set by the minimum temperature of the refrigeration source as well as the heat transfer and flow characteristics of the condenser. When the amount of nitrogen present on the condensing side is great enough, a portion remains uncondensed. Unless it is withdrawn, the presence of this uncondensed nitrogen gas begins to drive down the required condensing temperature. A nitrogen gas buildup can rapidly reduce the amount of gas that can be liquefied. Since it is the condensing action that draws the feed flow into the bottom of the crude argon column, a reduction in the quantity of gas condensed causes an equal reduction in the column feed flow. With a significant reduction of column feed flow, the liquid on the distillation stages will not be properly supported by the rising gas so excessive amounts of liquid will then fall to the column sump. This loss of gas feed and resultant liquid dumping causes the crude argon column to stop working. This usually leads to a severe upset in the lower pressure column with which the crude argon column is integrated. In order to avoid this rapidly occurring nitrogen induced upset, especially during plant capacity changes, prepurifier bed switches or other operating mode changes, the crude argon column feed flow is often controlled to maintain its nitrogen concentration at a low value. Unfortunately, the consequence of maintaining the nitrogen at a low value means that the argon concentration as well as the total flow rate of the crude argon column feed stream are also maintained at a low value. Since only the argon actually drawn into the crude argon column has a chance of being recovered, this leads to a reduction in the argon production.

Accordingly, it is an object of this invention to provide a cryogenic air separation method wherein argon production may be increased.

SUMMARY OF THE INVENTION

The above and other objects, which will become apparent to those skilled in the art upon a reading of this disclosure, are attained by the present invention which is:

A method for producing argon by cryogenic rectification comprising:

(A) passing feed air into a higher pressure column of a cryogenic air separation plant which also comprises a lower pressure column and an argon column having a top condenser, and separating the feed air by cryogenic rectification within the higher pressure column to produce oxygen-enriched liquid and nitrogen-enriched vapor;

(B) passing argon-containing fluid from the lower pressure column as feed into the argon column and producing crude argon vapor by cryogenic rectification within the argon column;

(C) withdrawing oxygen-enriched liquid from the higher pressure column and mixing liquid nitrogen with oxygen-enriched liquid withdrawn from the higher pressure column to produce a liquid refrigeration mixture;

(D) condensing at least some of the crude argon vapor by indirect heat exchange with the liquid refrigeration mixture in the argon column top condenser to produce crude argon liquid and vaporized refrigeration mixture;

(E) passing vaporized refrigeration mixture from the argon column top condenser into the lower pressure column; and (F) recovering some of at least one of the crude argon vapor and crude argon liquid as product argon.

As used herein the term "feed air" means a mixture comprising primarily oxygen, nitrogen and argon, such as ambient air.

As used herein the term "liquid nitrogen" means a liquid having a nitrogen concentration of at least 60 mole percent.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "top condenser" means a heat exchange device that generates column downflow liquid from column vapor. The top condenser may be physically within or may be outside the column.

As used herein the terms "turboexpansion" and "turboexpander" mean respectively method and apparatus for the flow of high pressure gas through a turbine to reduce the pressure and the temperature of the gas thereby generating refrigeration.

As used herein the terms "upper portion" and "lower portion" means those sections of a column respectively above and below the mid point of the column.

As used herein the term "subcooling" means cooling a liquid to be at a temperature lower than that liquid's saturation temperature for the existing pressure.

BRIEF DESCRIPTION OF THE DRAWING

The sole FIGURE is a schematic representation of one arrangement for practicing a preferred embodiment of the method of invention.

DETAILED DESCRIPTION

The invention will be described in detail with reference to the Drawing. Referring now to the FIGURE, feed air 1, which has been cleaned of high boiling impurities such as carbon dioxide, water vapor and hydrocarbons, is cooled in primary heat exchanger 2 by indirect heat exchange with return streams to produce cooled feed air stream 3. In the embodiment of the invention illustrated in the FIGURE, feed air is passed into both the higher pressure column and the lower pressure column of the double column of the cryogenic air separation plant. A portion 4 of the cooled feed air is passed into higher pressure column 105 of the cryogenic air separation plant which also comprises lower pressure column 130 and argon column 150. Another portion 5 of the cooled feed air is at least partially condensed by partial traverse of heat exchanger 6 and the resulting feed air portion 7 is passed into higher pressure column 105. A third portion 8 of the cooled feed air is turboexpanded by passage through turboexpander 9 and the resulting turboexpanded feed air portion 10 is passed into lower pressure column 130.

Higher pressure column 105 is operating at pressure generally within the range of from 65 to 130 pounds per square inch absolute (psia). Within higher pressure column 105 the feed air is separated by cryogenic rectification into nitrogen-enriched vapor and oxygen-enriched liquid. Oxygen-enriched liquid, having an oxygen concentration generally within the range of from 30 to 38 mole percent, is withdrawn from the lower portion of column 105 in stream 11, subcooled, generally by about from 3 to 8K, by passage through heat exchanger 6, and resulting subcooled oxygen-enriched liquid 12 is passed into boiling side 120 of argon column top condenser 160. Nitrogen-enriched vapor is passed in stream 13 to bottom reboiler 14 wherein it is condensed by indirect heat exchange with lower pressure column bottom liquid. A portion 41 of resulting nitrogen-enriched liquid 40 is returned to the upper portion of column 105 as reflux, and another portion 44 of nitrogen-enriched liquid 40 is subcooled by passage through heat exchanger 6, generally by from about 14 to 18K. Resulting subcooled nitrogen-enriched liquid 42 is passed into the upper portion of lower pressure column 130 as reflux.

An argon-containing fluid, typically comprising from about 9 to 15 mole percent argon, from about 200 to 1200 parts per million (ppm) nitrogen, with the balance essentially all oxygen, is passed in stream 200 as argon column feed from lower pressure column 130 into argon column 150. Within argon column 150 the argon column feed is separated by cryogenic rectification into crude argon vapor and oxygen-richer liquid. Oxygen-richer liquid is passed in stream 201 from the lower portion of argon column 150 in lower pressure column 130.

In the practice of this invention liquid nitrogen is mixed with oxygen-enriched liquid to form a liquid refrigeration mixture which is used to drive the argon column top condenser. The liquid nitrogen may be mixed with the oxygen-enriched liquid outside of the argon column top condenser and the resulting refrigeration mixture passed into the boiling side of the argon column top condenser. In the embodiment of the invention illustrated in the FIGURE, the liquid nitrogen and the oxygen-enriched liquid are passed separately into the boiling side of the argon column top condenser and mixed therein to form the refrigeration mixture. The liquid nitrogen for mixture with the oxygen-enriched liquid may be from any suitable source. The embodiment of the invention illustrated in the FIGURE is a preferred embodiment wherein the source of the liquid nitrogen is the subcooled nitrogen-enriched liquid. Other sources of the liquid nitrogen for the practice of this invention include liquid from other levels of the higher pressure or lower pressure columns, and liquid from a storage tank.

Referring back now to the FIGURE, a portion 43 of nitrogen-enriched liquid stream 42, generally comprising less than 5 percent of the flow and typically about 1.5 percent of the flow of stream 42, is passed into the boiling side 120 of argon column top condenser 160. Crude argon vapor, generally comprising from about 96 to 98.5 percent argon, from about 1 to 2.5 mole percent oxygen and from about 0.5 to 2 mole percent nitrogen, is passed into the condensing side 131 of argon column top condenser 160 as shown by stream 15. Within argon column top condenser 160 the crude argon vapor is condensed by indirect heat exchange with the liquid refrigeration mixture resulting in the production of crude argon liquid and vaporized refrigeration mixture. The crude argon liquid 16 is used as reflux in argon column 150. A portion 204 of the crude argon liquid may be recovered as product argon. In addition to or in place of stream 204, a portion of the crude argon vapor may be recovered as product argon. Vaporized refrigeration mixture is passed in stream 202 from argon column top condenser 160 into lower pressure column 130. In the embodiment of the invention illustrated in the FIGURE, some remaining liquid refrigeration mixture in stream 203 is also passed from argon column top condenser 160 into lower pressure column 130.

By the mixture of the liquid nitrogen and the oxygen-enriched liquid to form the refrigeration mixture for the argon column top condenser, the boiling temperature is reduced by as much as 1 Kelvin while operating at the same boiling side pressure. For a given condenser and its heat transfer characteristics, this also reduces the minimum condensing side temperature by a similar amount. The advantage that this presents is that the condensing crude argon gas stream may be richer in nitrogen before an instability causing limitation is reached. With the greater tolerance for nitrogen in the condensing stream, more feed flow (1–10%) may be drawn into the argon column. The benefit of a greater feed flow is that more argon is also drawn into the column, thereby providing a proportionate increase in the amount of argon that can be recovered. The net result is an increase in argon production while maintaining a comfortable margin away from nitrogen induced process upsets.

Lower pressure column 130 is operating at a pressure less than that of higher pressure column 105 and generally within the range of from 17 to 30 psia. Within lower pressure column 130 the various feeds into that column are separated by cryogenic rectification into nitrogen-rich fluid and oxygen-rich fluid. Nitrogen-rich fluid is withdrawn from the upper portion of column 130 as vapor stream 17, warmed by passage through heat exchangers 6 and 2, and recovered as product nitrogen in stream 18 generally having a nitrogen concentration of at least 98 mole percent. For product purity control purposes a waste stream 19 is withdrawn from the upper portion of column 130 below the withdrawal level of stream 17, warmed by passage through heat exchangers 6 and 2, and removed from the system in stream 20.

Oxygen-rich fluid is recovered from the lower portion of lower pressure column 130 as product oxygen having an oxygen concentration generally within the range of from 98 to 100 mole percent. In the embodiment of the invention illustrated in the FIGURE, oxygen-rich liquid is withdrawn from column 130 as vapor stream 21, warmed by passage through primary heat exchanger 2, and recovered as product oxygen in stream 22. In addition to or in place of the gaseous oxygen product, oxygen-rich fluid may be recovered from column 130 as liquid and recovered as liquid oxygen product.

Although the invention has been discussed in detail with reference to certain preferred embodiments, those skilled in the art will recognize that there are other embodiments of the invention within the spirit and the scope of the claims.

What is claimed is:

1. A method for producing argon by cryogenic rectification comprising:

(A) passing feed air into a higher pressure column of a cryogenic air separation plant which also comprises a lower pressure column and an argon column having a top condenser, and separating the feed air by cryogenic rectification within the higher pressure column to produce oxygen-enriched liquid and nitrogen-enriched vapor;

(B) passing argon-containing fluid from the lower pressure column as feed into the argon column and producing crude argon vapor by cryogenic rectification within the argon column;

(C) withdrawing oxygen-enriched liquid from the higher pressure column and mixing liquid nitrogen with oxygen-enriched liquid withdrawn from the higher pressure column to produce a liquid refrigeration mixture;

(D) condensing at least some of the crude argon vapor by indirect heat exchange with the liquid refrigeration mixture in the argon column top condenser to produce crude argon liquid and vaporized refrigeration mixture;

(E) passing vaporized refrigeration mixture from the argon column top condenser into the lower pressure column; and (F) recovering some of at least one of the crude argon vapor and crude argon liquid as product argon.

2. The method of claim 1 wherein the withdraw oxygen-enriched liquid and the liquid nitrogen are passed separately into the argon column top condenser and mixed therein to produce the liquid refrigeration mixture.

3. The method of claim 1 further comprising turboexpanding a portion of the feed air and passing the turboexpanded feed air portion into the lower pressure column.

4. The method of claim 1 wherein nitrogen-enriched vapor produced in the higher pressure column is condensed and passed into the argon column top condenser as said liquid nitrogen.

5. The method of claim 4 wherein said condensed nitrogen-enriched vapor is subcooled prior to being passed into the argon column top condenser.

6. The method of claim 1 further comprising passing some liquid refrigeration mixture from the argon column top condenser into the lower pressure column.

7. The method of claim 1 wherein some of the crude argon liquid is recovered as the product argon.

8. The method of claim 1 further comprising producing by cryogenic rectification nitrogen-rich fluid and oxygen-rich fluid within the lower pressure column.

9. The method of claim 8 further comprising recovering nitrogen-rich fluid from the upper portion of the lower pressure column as product nitrogen.

10. The method of claim 8 further comprising recovering oxygen-rich fluid from the lower portion of the lower pressure column as product oxygen.

* * * * *